US005181070A

United States Patent [19]

Masuda

[11] Patent Number: 5,181,070

[45] Date of Patent: Jan. 19, 1993

[54] PROCESS CARTRIDGE AND IMAGE FORMING APPARATUS USING SUCH CARTRIDGE

[75] Inventor: Toshiki Masuda, Toyokawa, Japan

[73] Assignee: Minolta Camera Kabushiki Kaisha, Osaka, Japan

[21] Appl. No.: 619,005

[22] Filed: Nov. 28, 1990

[30] Foreign Application Priority Data

Nov. 29, 1989 [JP] Japan ..... 1-311804

[51] Int. Cl.[5] ..... G03G 15/00

[52] U.S. Cl. ..... 355/200; 355/208; 355/225

[58] Field of Search ..... 355/200, 208, 210, 211, 355/221, 225

[56] References Cited

U.S. PATENT DOCUMENTS

| | | | |
|---|---|---|---|
| 4,607,941 | 8/1986 | Honda | 355/210 |
| 4,618,249 | 10/1986 | Minor | 355/221 X |
| 4,695,723 | 9/1987 | Minor | 355/225 X |
| 4,939,542 | 7/1990 | Kurando et al. | 355/208 |
| 4,987,446 | 1/1991 | Mochimaru et al. | 355/200 |
| 5,008,707 | 4/1991 | Ewing et al. | 355/220 |
| 5,060,017 | 10/1991 | Ueda | 355/221 |

FOREIGN PATENT DOCUMENTS 59-147376 8/1984 Japan .

*Primary Examiner*—A. T. Grimley
*Assistant Examiner*—P. J. Stanzione
*Attorney, Agent, or Firm*—Burns, Doane, Swecker & Mathis

[57] ABSTRACT

A process cartridge removably mounted with respect to the body of an image forming apparatus, which includes an image bearing member, a charging device for uniformly charging the surface of said image bearing member, with the charging device including a discharge electrode and a control electrode, a device for regulating the potential of the control electrode to a predetermined value, and an operation change-over device for rendering the regulating device operative or inoperative.

11 Claims, 6 Drawing Sheets

PROCESS CARTRIDGE AND IMAGE FORMING APPARATUS USING SUCH CARTRIDGE

BACKGROUND OF THE INVENTION

1. Field of the Invention

The present invention relates to image forming apparatus such as copying machines, laser beam printers or liquid crystal printers, and more particularly to image forming apparatus including a process cartridge which has incorporated therein at least an electrophotographic photosensitive member or like image bearing member and which is removably and replaceably installed in the body of the apparatus.

2. Description of the Related Art

With electrophotographic image forming apparatus, the electrostatic and physical characteristics of the material of the photoconductive layer formed on the photosensitive drum are a factor for determining the design specifications (as to image forming conditions) such as the image forming velocity of the apparatus. Generally, therefore, the type of photosensitive member to be used differs with the image forming velocity. For example, photosensitive drums coated with an inorganic photoconductive material, such as α-Si or Se, are used for image forming apparatus set to a high image forming velocity (hereinafter referred to as "high speed machines"), while photosensitive drums coated with an organic photoconductive material are employed for apparatus set to a relatively low image forming velocity (hereinafter referred to as "low speed machines"). However, photosensitive drums of either type deteriorate in electrostatic or physical characteristics with repetitions of image forming operation, so that the drum which has served for life, as estimated from the number of repetitions of image formation, is replaced by a new one. Further the expendables which must be replaced for use in image forming apparatus include the developing unit, cleaner, etc. in addition to the photosensitive drum.

Image forming apparatus are already known which have a cartridge removably installed therein and incorporating a charger, photosensitive drum, developing unit and cleaner as arranged together within a frame so as to facilitate the replacement of such expendables (U.S. Pat. No. 4,607,941). With the known apparatus, the cartridge in service is replaced by new one, for example, with reference to the life of the drum as a standard. The charger for use in charging the surface of the photosensitive drum is a scorotron charger which comprises a wire electrode for effecting corona discharge, a shield member partly surrounding the electrode and a grid electrode grounded via a constant-voltage device (varistor). With this charger, corona discharge produces a corona current, and the corona current flowing through the grid electrode is passed through the constant-voltage device to maintain the grid electrode at a predetermined potential. Thus, the charge potential of the photosensitive drum is dependent on the potential of the grid electrode. The charge potential of the drum is dependent also on the image forming velocity, i.e., on the peripheral speed of the drum. When the grid potential is at a given level, the higher the peripheral speed, the lower is the drum charge potential.

With image forming apparatus having a cartridge as described above, there arises a need to reduce the production cost in recent years by using common expendables for apparatus which are different in design specifications, in addition to facilitating the replacement of expendables. For example, in the case where an existing product (e.g., low speed machine) is to be modified for sophistication to commercially provide a new product (e.g., high speed machine), it is desired to make expendables for the new product usable also for the existing product. In this case, the photoconductive material for coating the photosensitive drum or the constant-voltage device (varistor) to be connected to the grid electrode must be a material or a device of rated value which is adapted for use in the high speed machine so that the drum surface can be charged to the desired potential even when the drum is rotated at a high speed.

With conventional image forming apparatus, nevertheless, the process cartridge for use in a particular apparatus is in conformity with the design specifications (e.g., image forming velocity) of that apparatus only. Accordingly, if the process cartridge for the high speed machine is used for the low speed machine, the surface of the photosensitive drum is charged excessively and results in various objections. For example, when a two-component developer containing a carrier and a toner is used for reversal development, the carrier is deposited on edge portions of images of small area such as characters or on nonimage areas to smudge the copy images. Such deposition of carrier varies the standard toner-to-carrier ratio of the developer, leading to the supply of an excess of toner and consequently failing to triboelectrically charge the toner with the carrier effectively. The toner which is not charged as desired fails to give copy images of desired image density. The toner further becomes prone to spill over and soil the detection faces of sensors which are arranged at various locations in the interior of the image forming apparatus to result in detection errors. To obviate these objections, there is a need to replace the constant-voltage device provided in the low speed machine by one having a rated value for use in the high speed machine, whereas the replacement requires dispatch of a special serviceman and imposes an excessive burden on the user.

SUMMARY OF THE INVENTION

The main object of the present invention, which is proposed in view of the foregoing situation, is to provide a process cartridge which is compatible with and usable in common for image forming apparatus which are different in design specifications.

Another object of the present invention is to provide a process cartridge adapted for use in an image forming apparatus and reliably settable to a proper charging condition in accordance with the image forming velocity of the apparatus merely when installed therein, and to provide such an image forming apparatus having the process cartridge incorporated therein.

To fulfill these objects, the present invention provides a process cartridge which is removably replaceably installable in the body of an image forming apparatus and which comprises an image bearing member rotatable in a specified direction, charging means including a discharge electrode and a control electrode for uniformly charging the surface of the image bearing member, means for regulating the potential of the control electrode to a predetermined value, and operation change-over means for rendering the regulating means operative or inoperative.

The presence of the regulating means and the operation change-over means makes it possible to provide a compatible process cartridge which is intended for use in an image forming apparatus set, for example, to a high image forming velocity and which is nevertheless usable also for an image forming apparatus set to a low image forming velocity when installed therein.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DESCRIPTION OF THE PREFERRED EMBODIMENT

The present invention will be described below with reference to the drawings showing an embodiment thereof.

Figure 1:
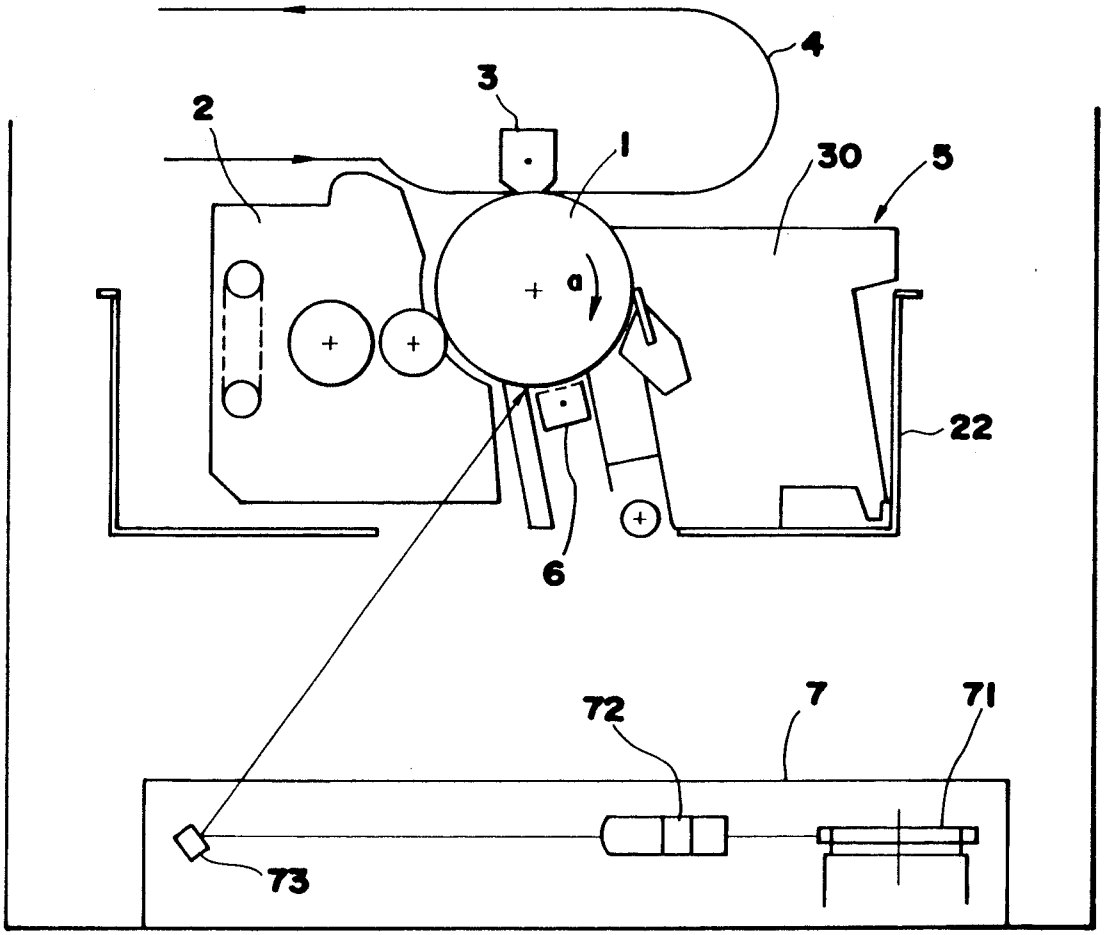
FIG. 1 is a side elevation in section schematically showing the image forming assembly of a laser beam printer as an image forming apparatus having a process cartridge installed therein and embodying the invention.

FIG. 1 is a schematic side elevation in section showing the construction of the image forming assembly of a laser beam printer which is an image forming apparatus having a process cartridge embodying the invention. The laser beam printer prints images on a continuous sheet of paper. Indicated at 7 in the drawing is an optical unit disposed in the lower portion of the body of the printer. With the optical unit 7, a modulated beam emitted by an unillustrated semiconductor laser is projected on a photosensitive drum 1 to scan the drum surface in the main scanning direction by way of a polygonal mirror 71, F-$\theta$ lens and mirror 73. The photosensitive drum 1 serving as an image bearing member is disposed approximately in the central portion of the printer body. Arranged around the drum 1 are a charger 6 for charging the surface of the drum 1 to a predetermined potential, a magnetic brush developing unit 2 for developing with toner an electrostatic latent image formed on the drum surface with the modulated beam projected thereon, a transfer device 3 for transferring the toner image from the drum to continuous paper 4 such as fanfold paper, and a cleaner 30 having a scraper for removing residual toner from the drum surface. These components are arranged one after another in the direction of arrow a (direction of rotation of the drum 1).

The process cartridge, indicated at 5, holds the drum 1, cleaner 30 and charger 6 together, and is removably provided in the support (hereinafter referred to as the "cartridge holder") 22 to be described below.

Figure 2:
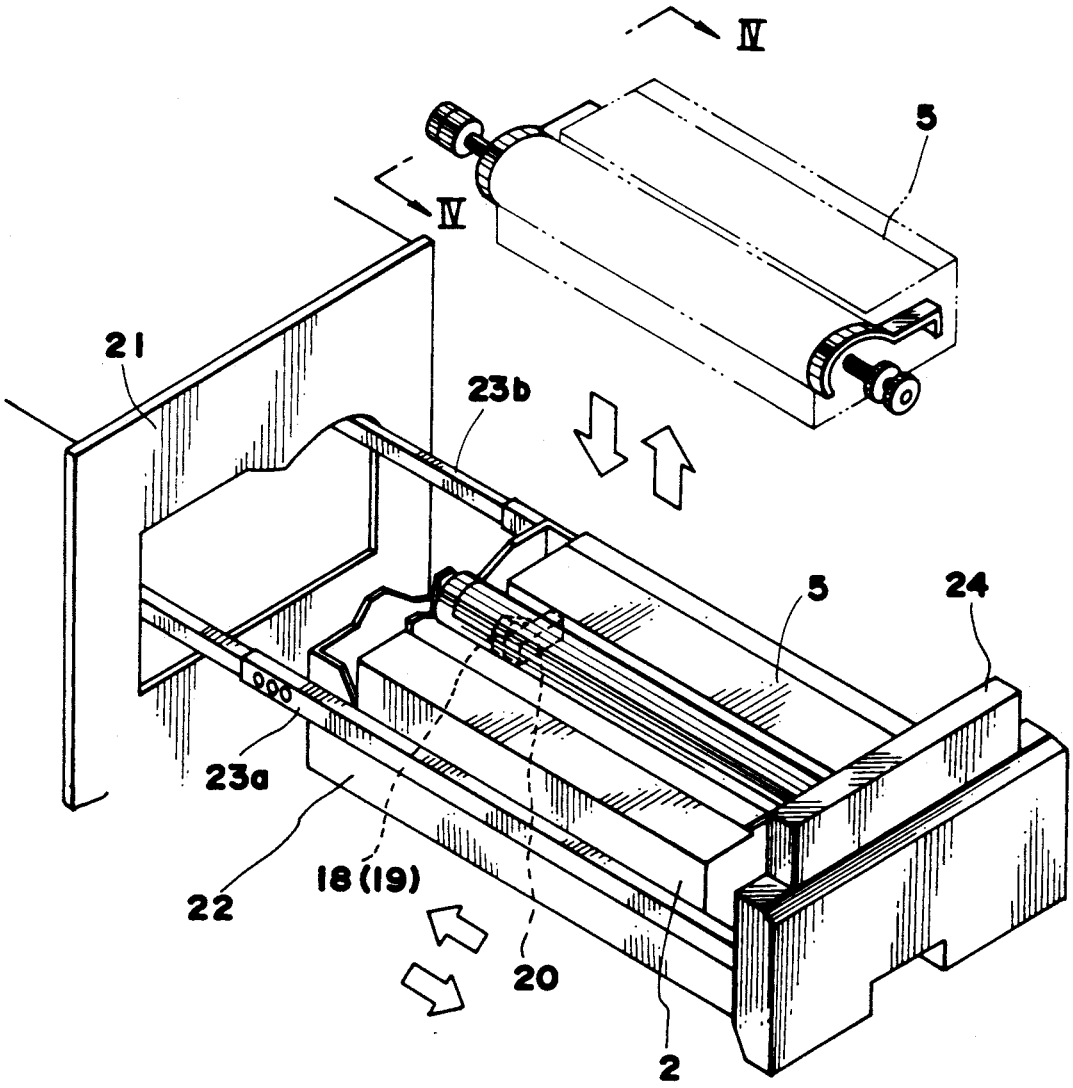
FIG. 2 is a perspective view showing the construction of a holder for the process cartridge.
Figure 3:
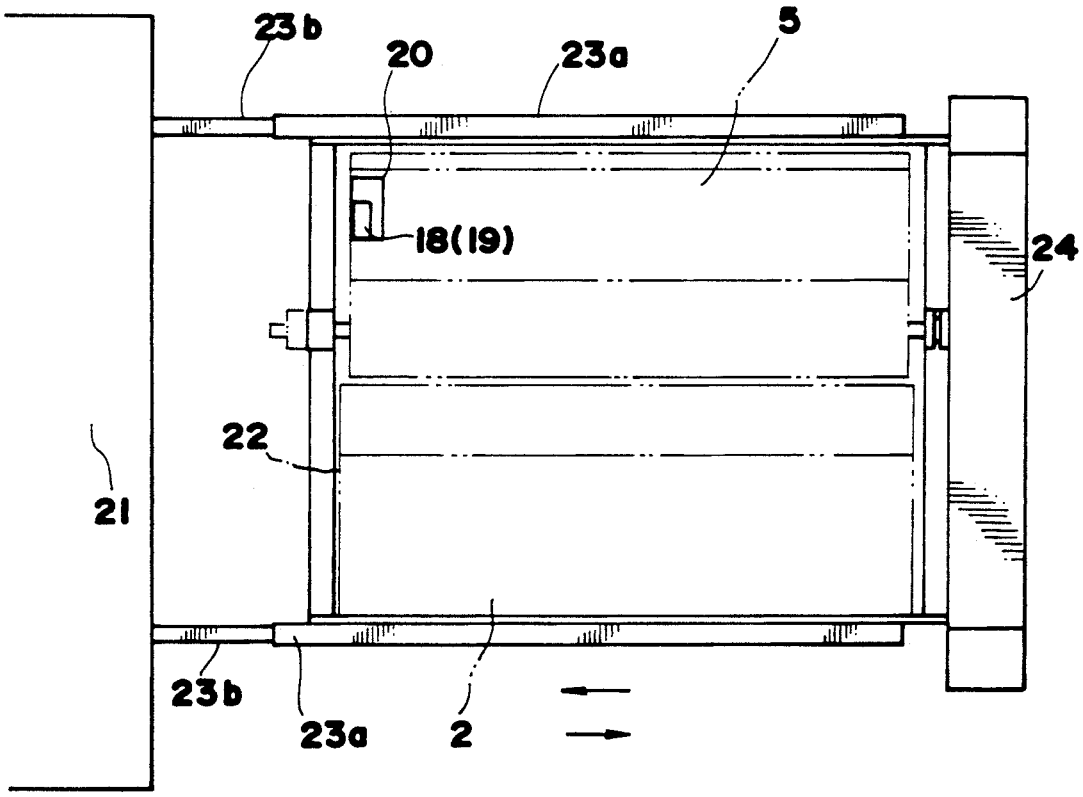
FIG. 3 is a plan view of FIG. 2.

FIG. 2 is a perspective view showing the construction of the cartridge holder 22, and FIG. 3 is a plan view of FIG. 3. Guide rails 23*b* attached to opposite sides of the cartridge holder 22 centrally thereof are engaged with guide bars 23*a* provided in the body 21 of the image forming apparatus and movable into or out of the body, whereby the cartridge holder 22 is withdrawably installed in the body 21. The holder 22 is in the form of a box and is open in the center of its bottom over the entire length thereof. The cartridge holder 22 has arranged thereon the developing unit 2, the process cartridge 5 and a toner hopper 24 for replenishing the toner-containing developing unit 2 with the toner. As indicated in phantom line in FIG. 2, the developing unit 2 and the process cartridge 5 are removably provided on the holder 22. Disposed in the bottom portion of the cartridge holder 22 toward the apparatus body 21 is a holder 20 accommodating a varistor 10*b* shown in FIG. 5 and serving as a constant-voltage device as will be described later. Attached to one side of the holder 20 is a terminal 18 (or 19) made of an electrically conductive material and bent in the form of an upwardly projecting ridge. One end of the terminal 18 is connected to one end of the varistor 10*b*.

Figure 4:
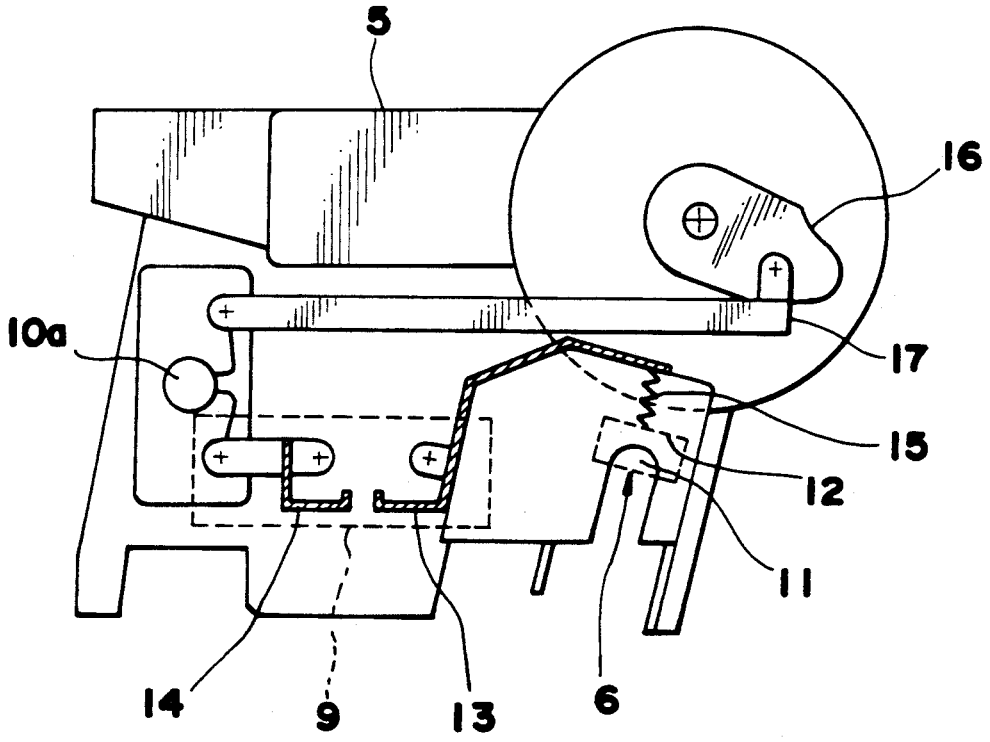
FIG. 4 is a sectional view of the process cartridge embodying the invention.

FIG. 4 is a side elevation in section taken along the line IV—IV in FIG. 2 and showing the construction of the process cartridge of the invention. On one side of the process cartridge 5 toward the body 21, a varistor 10*a* is provided which serves as voltage regulating means for regulating the voltage produced on the grid electrode of the scorotron charger. The rated voltage of the varistor 10*a* is 750 V. One end of the varistor 10*a* is connected to a grounded drum bearing 16 by a grounding member 17. The other end of the varistor 10*a* is connected to an L-shaped first terminal member 14, which is fixed to the side face of the process cartridge 5 and has an upwardly bent end opposed to a second terminal member 13.

Figure 6:
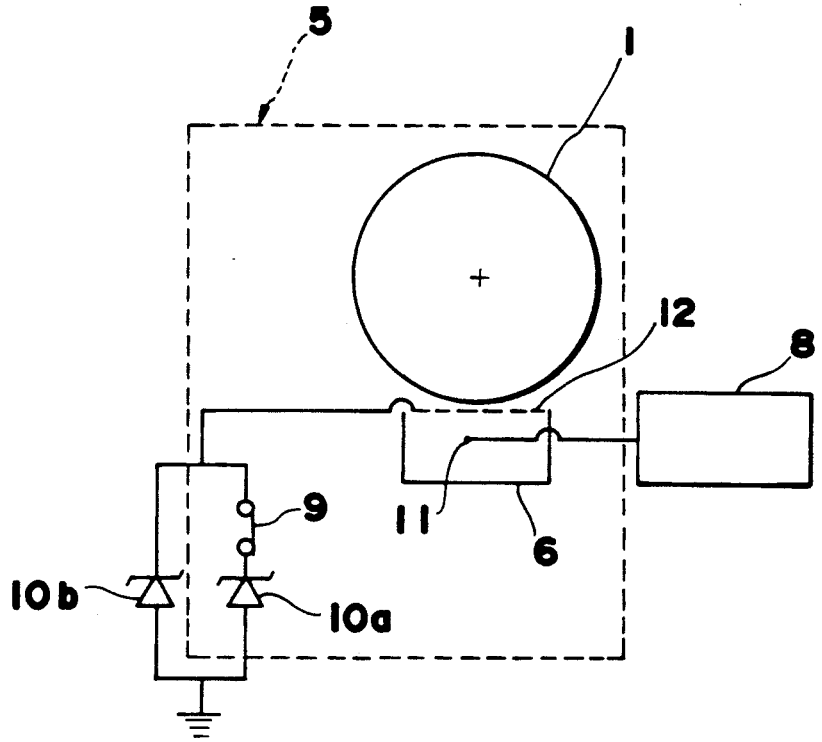
FIG. 6 (*a*) and FIG. 6 (*b*) are circuit diagrams showing the process cartridge as connected to the body of the image forming apparatus.
Figure 6:
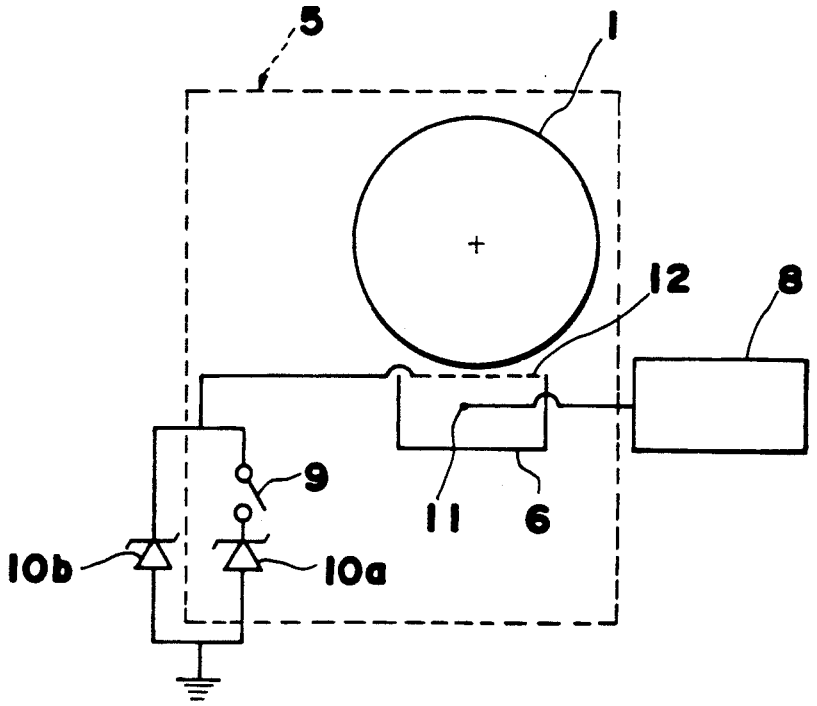

The second terminal member 13 is fixed to the side face of the process cartridge 5 and has one end which is bent upward to oppose the first terminal member 14. The other end of the second terminal member 13 is connected to the grid or central electrode 12 of the charger 6 by a spring 15. The charger 6 has a discharge wire or electrode 11 which is connected to a d.c. high voltage source 8 as seen in FIG. 6. These first and second terminal members 14, 13 constitute a switch portion or change-over switch 9 serving as means for rendering the varistor 10*a* operative or inoperative.

Figure 5:
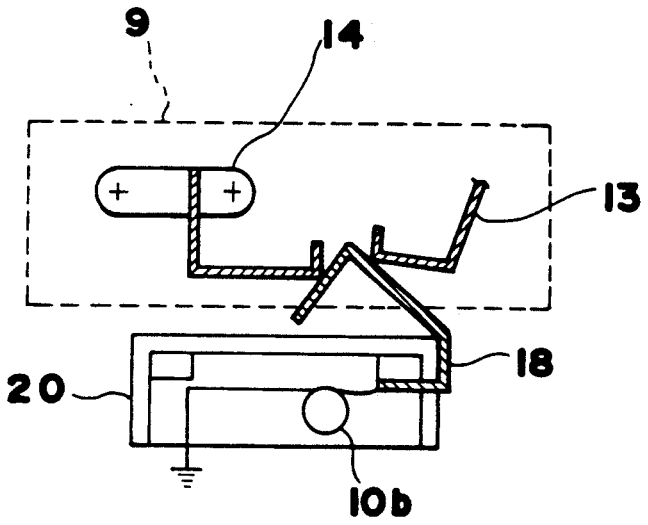
FIG. 5 (*a*) and FIG. 5 (*b*) are fragmentary side elevations showing the process cartridge as mounted on the cartridge holder.
Figure 5:
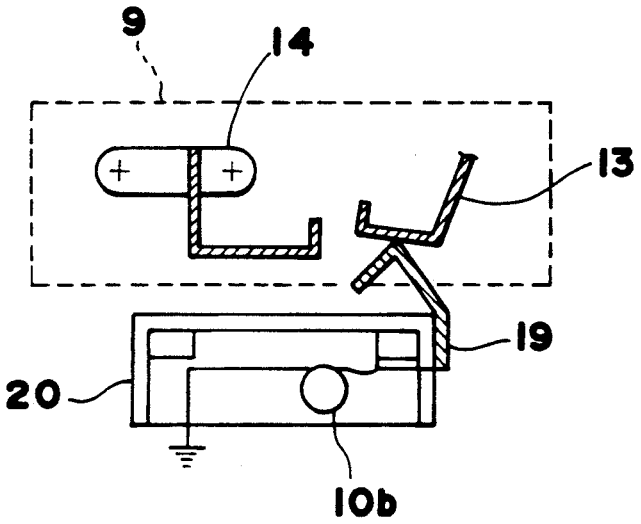

FIGS. 5 (*a*) and 5 (*b*) are fragmentary side elevations showing the process cartridge 5 as mounted on the cartridge holder 22. More specifically, FIG. 5 (*a*) shows a case wherein the cartridge is installed in a laser beam printer set to a relatively low image forming velocity (hereinafter referred to as the "low speed machine"). FIG. 5 (*b*) shows a case wherein the cartridge is installed in a laser beam printer set to a high image forming velocity (hereinafter referred to as the "high speed machine"). The varistor 10*b* provided in the holder 20 is 820 V in rated voltage and has one end connected to the terminal 19 and the other end grounded. In the case of the low speed machine shown in FIG. 5 (*a*), the top of the ridge of the terminal 18 attached to the holder 20 is located at the position where the first and second terminal members 14, 13 are opposed to each other, such that when the process cartridge 5 is mounted on the cartridge holder 22, the first and second terminal members are brought into conduction, turning on the switch portion 9.

In the case of the high speed machine shown in FIG. 5 (*b*), the top of the ridge of the terminal 19 is positioned approximately at the center of the horizontal portion of the second terminal member 13, such that when the process cartridge 5 is mounted on the cartridge holder 22, the terminal 19 comes into contact with the second terminal member 13, holding the switch portion 9 in off state.

FIGS. 6 (*a*) and 6 (*b*) are circuit diagrams showing the connection between the process cartridge and the body of the printer when the cartridge is mounted in place, in corresponding relation with FIGS. 6 (*a*) and 6 (*b*). Thus, FIG. 6 (*a*) shows the low speed machine, and FIG. 6 (*b*) high speed machine. In the case of the low speed machine, the switch portion 9 is on, and the potential of a first grid 12 is set to 750 V which is the rated voltage of the varistor 10*a* (see FIG. 6 (*a*)).

Accordingly, when the discharge wire 11 starts corona discharge, the potential of the grid 12 is maintained at 750 V. The surface potential of the drum 1 is approximately 750 V in this case since the drum 1 is in rotation at a low speed. In the case of the high speed machine, on the other hand, the switch portion or change-over switch 9 is off as seen in FIG. 6 (*b*), and the grid voltage is set to 820 V which is the rated voltage of varistor 10*b*. Thus, the grid voltage is made higher in the high speed machine than in the low speed machine for the following reason. The charge potential of the photosensitive drum surface is dependent on the image forming velocity, in other words, on the peripheral speed of the drum. At a given grid potential, the higher the peripheral speed, the lower is the charge potential of the drum. To give the same drum charge potential to the high speed machine and the low speed machine, the grid voltage must therefore be higher in the high speed machine than in the low speed machine. In this case, the surface potential of the drum 1 is about 750 V since the drum 1 is in rotation at a high speed.

When there arises a need to alter the grid voltage to make the drum surface potential of the high speed machine equal to that of the low speed machine as when a process cartridge set to the image forming condition for the low speed machine is to be used for the high speed machine, the need can be met without modifying the machine body by the process cartridge of the invention which is compatible with both the low and high speed machines since the present process cartridge is provided with the varistor 10*a* and means for rendering this varistor operative or inoperative.

Although the grid voltage regulating means used in the present embodiment is a varistor, the invention is not limited thereto, but other voltage regulating means, such as a Zener diode, is usable insofar as it is capable of regulating the grid voltage.

The switch portion is provided by terminals according to the present embodiment, whereas the invention is not limited to such a switch portion. For example, the process cartridge may be provided with a switch for selecting the varistor.

Further although the photosensitive drum, cleaner and charger are assembled into a process cartridge according to the embodiment described, also usable is a process cartridge which comprises the drum and developing unit, or the drum, developing unit and cleaner. In this case, the charger may be provided on either one of the process cartridge and the apparatus body. Unlike the embodiment wherein the cartridge holder is used, the process cartridge may be removably installed directly in the apparatus.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A process cartridge removably replaceably installable in the body of an image forming apparatus, comprising:

an image bearing member rotatable in a specified direction;

a charging means including a discharge electrode and a control electrode for uniformly charging the surface of said image bearing member;

a regulating means for regulating the potential of said control electrode to a predetermined value; and an operation change-over means for cooperating with an actuating means mounted on said body and rendering said regulating means operative or inoperative according to an image forming velocity set for said image forming apparatus.

2. A process cartridge as claimed in claim 1, wherein said operation change-over means comprises a terminal which is connected to said regulating means and a terminal which is connected said control electrode

3. A process cartridge as claimed in claim 2, wherein said charging means is a scorotoron charger and said control electrode is a grid electrode.

4. A process cartridge as claimed in claim 3, wherein said regulating means is a varistor.

5. An image apparatus comprising:

a main body including operative components;

an interchangeable process cartridge detachably mounted to said main body, said process cartridge having an image bearing member rotatable in one direction, a charging means including a discharge electrode and a control electrode for uniformly charging the surface of said image bearing member, a first regulating means for regulating the potential of said control electrodes to a first predetermined value, a housing for integrally supporting said image bearing member and said charging means and said first regulating means, and an operation change-over means provided on the exterior of said housing for rendering said first regulating means operative or inoperative;

a guide member for guiding the movement of said cartridge when said cartridge is mounted to or dismounted from said main body;

a second regulating means mounted on said main body for regulating the potential of said control electrodes to a second predetermined value independent of said first regulating means.

6. An image forming apparatus as claimed in claim 5, wherein said operation change-over means comprises a terminal which is connected to said first regulating means and a terminal which is connected to said control electrode, whereby said both terminals constitute a switch portion.

7. An image forming apparatus as claimed in claim 6, wherein said charging means is a scorotoron charge and said control electrode is a grid electrode.

8. An image forming apparatus as claimed in claim 7, wherein said first regulating means is a varistor.

9. An image forming apparatus as claimed in claim 5, further comprises an actuating means for actuating said second regulating means by cooperation with said operation change-over means.

10. An image forming apparatus as claimed in claim 9, wherein said second regulating means is a varistor.

11. An image forming apparatus as claimed in claim 10, wherein said actuating means is a terminal which is connected to said varistor.

* * * * *